US011831081B2

(12) United States Patent
Xing et al.

(10) Patent No.: US 11,831,081 B2
(45) Date of Patent: Nov. 28, 2023

(54) RADIATION ASSEMBLY, WAVEGUIDE ANTENNA SUB-ARRAY, AND WAVEGUIDE ARRAY ANTENNA

(71) Applicants: NORTHWEST INSTRUMENT INC., Dover, NJ (US); NORTHWEST INSTRUMENT(SHANGHAI) CO., LTD., Shanghai (CN)

(72) Inventors: David Xing, Dover, NJ (US); Lei Wang, Shanghai (CN); Xiaolin Lv, Shanghai (CN); Xin Shi, Shanghai (CN)

(73) Assignees: NORTHWEST INSTRUMENT INC., Dover, NJ (US); NORTHWEST INSTRUMENT (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/859,749

(22) Filed: Jul. 7, 2022

(65) Prior Publication Data

US 2022/0344829 A1 Oct. 27, 2022

Related U.S. Application Data

(63) Continuation of application No. PCT/CN2020/078302, filed on Mar. 6, 2020.

(51) Int. Cl.
*H01Q 21/00* (2006.01)
*H01Q 21/06* (2006.01)

(52) U.S. Cl.
CPC ..... *H01Q 21/064* (2013.01); *H01Q 21/0031* (2013.01); *H01Q 21/0087* (2013.01)

(58) Field of Classification Search
CPC ..... H01Q 21/0043; H01Q 21/005; H01Q 21/0031; H01Q 21/0087; H01Q 21/0093; H01Q 21/064; H01Q 21/0025
See application file for complete search history.

(56) References Cited

U.S. PATENT DOCUMENTS

| | | | | |
|---|---|---|---|---|
| 9,472,853 | B1 | 10/2016 | Smith | |
| 2017/0244173 | A1 | 8/2017 | Moon et al. | |
| 2018/0358709 | A1* | 12/2018 | You | H01Q 21/064 |

FOREIGN PATENT DOCUMENTS

| | | | |
|---|---|---|---|
| CN | 107342454 | A | 11/2017 |
| CN | 108461928 | A | 8/2018 |
| CN | 108598697 | A | 9/2018 |

OTHER PUBLICATIONS

T. Tomura, Y. Miura, M. Zhang, J. Hirokawa and M. Ando, "A 45$^\circ$ Linearly Polarized Hollow-Waveguide Corporate-Feed Slot Array Antenna in the 60-GHz Band," in IEEE Transactions on Antennas and Propagation, vol. 60, No. 8, pp. 3640-3646, Aug. 2012 (Year: 2012).*

(Continued)

*Primary Examiner* — Robert Karacsony
(74) *Attorney, Agent, or Firm* — ANOVA LAW GROUP, PLLC

(57) ABSTRACT

The present disclosure relates to a radiation assembly, a waveguide antenna sub-arrays, and a waveguide array antenna. The radiation assembly for the waveguide array antenna comprises: a first radiation layer having a plurality of first radiation windows, each of the plurality of first radiation windows has a metal grid that divides the corresponding first radiation window into two radiation holes; and a second radiation layer having a plurality of second radiation windows, the plurality of second radiation windows has a one-to-one correspondence with the plurality of first radiation windows, and the plurality of second radiation windows of the second radiation layer do not have a metal grid. The thickness of the second radiation layer is greater than the thickness of the first radiation layer, and the first radiation layer and the second radiation layer are manufactured independently of each other.

15 Claims, 16 Drawing Sheets

(56) References Cited

OTHER PUBLICATIONS

The World Intellectual Property Organization (WIPO) International Search Report With Translation and Written Opinion for PCT/CN2020/078302 dated Dec. 1, 2020 6 pages.
European Patent Office Supplementary European Search Report for EP 20838868.6 dated Jun. 28, 2022 9 pages.

* cited by examiner

RADIATION ASSEMBLY, WAVEGUIDE ANTENNA SUB-ARRAY, AND WAVEGUIDE ARRAY ANTENNA

CROSS-REFERENCE TO RELATED APPLICATION

This application is a continuation application of PCT application PCT/CN2020/078302, filed on Mar. 6, 2020, the entire content of which is incorporated herein by reference.

FIELD OF THE DISCLOSURE

The present disclosure relates to technologies related to microwave antennas. Particularly, the present disclosure relates to a radiation assembly for a waveguide array antenna, a waveguide antenna sub-array, and a waveguide array antenna.

BACKGROUND

Firstly, traditional patch array antennas tend to be implemented in a single-layer PCB structure or a multi-layer PCB structure. The traditional patch array antennas have the characteristics of light weight, which is easy to be integrated with the device, and have certain advantages in terms of manufacturing consistency and costs. However, because the transmission loss of the micro grid line in the millimeter wave frequency is too large, and the mutual coupling of the radiation window aperture array elements also exists objectively, so that it is difficult for the micro grid patch array antenna to obtain a higher aperture radiation efficiency, a better XPD (cross polarization discrimination: antenna cross polarization) and a higher gain electrical index.

Secondly, for the traditional waveguide slot array, the transmission network adopts air waveguide transmission, which has a lower transmission loss value. The aperture tends to adopt a cavity array or a slot array, so it has unique advantages in index related to aperture efficiency and array elements mutual coupling, such as XPD and dual-polarized IPI (inter-port isolation). However, the array number of waveguide still depends on the selection of the array element spacing, the array element spacing of about 0.5 wavelengths makes the number of array elements in a limited area limited, and the continuity and uniformity of the field distribution still have certain defects. In addition, in terms of the pattern envelope, because of the regular distribution of the aperture field, it is difficult to form the amplitude distribution and achieve a lower pattern index of the side lobe.

This is because traditional radiation units for waveguide array antennas tend to be processed by way of processing the two edges of the radiation unit separately using opening molds, however, the manufacturing accuracy of such an integrated radiation unit is poor, which causes the antenna cross polarization to be poor, and cannot meet the Class 3 requirements of the European Standards Institute ETSI.

SUMMARY

In view of the above-mentioned technical problems, that is, the antennas with integrated radiation units have disadvantages like poor manufacturing accuracy; poor cross polarization, and fail to meet the Class 3 requirements of ETSI. To solve the above technical problems in the prior art, the first aspect of the present disclosure proposes a radiation assembly for a waveguide array antenna, the radiation assembly comprises:

- a first radiation layer having a plurality of first radiation windows, and each of the plurality of first radiation windows has a metal grid that divides the corresponding first radiation window into two radiation holes; and
- a second radiation layer having a plurality of second radiation windows, the plurality of second radiation windows has a one-to-one correspondence with the plurality of first radiation windows, and the plurality of second radiation windows of the second radiation layer do not have a metal grid,
- wherein the thickness of the second radiation layer is greater than the thickness of the first radiation layer, and wherein the first radiation layer and the second radiation layer are manufactured independently of each other.

With the help of adding a metal grid between the first edges of the radiation window of the radiation assembly, the radiation assembly improves the purity of the aperture radiation polarization without reducing the gain to achieve a higher antenna cross polarization (XPD) index. Moreover, the radiation assembly according to the present disclosure reduces the side lobe level, thereby meeting the ETSI level 3 requirements In one embodiment according to the present disclosure, the first radiation layer and the second radiation layer are connected by way of vacuum diffusion welding.

The radiation assembly according to the present disclosure is assembled by a vacuum diffusion welding process, and the radiation layer is independently manufactured by way of etching or laser engraving, thereby making the process accuracy higher and saving the corresponding mold-opening costs and reducing costs.

In one embodiment according to the present disclosure, the second radiation layer has at least two radiation sublayers, and the at least two radiation sublayers have the same structure. In some embodiments, in one embodiment according to the present disclosure, the first radiation window comprises two oppositely disposed first edges, and the metal grid is positioned between the two first edges of the first radiation window, and the first radiation window is equally divided into the two radiation holes. In some embodiments, the first radiation window further comprises a second edge connecting the two first edges, and the metal grid and the second edge of the first radiation window are disposed in parallel. The second edge is longer than the first edges.

In one embodiment according to the present disclosure, the thickness of the first radiation layer and the thickness of the second radiation layer are associated with an operating frequency of the signal sent by the radiation assembly. In some embodiments, the thickness of the first radiation layer is one twentieth of the wavelength corresponding to the operating frequency. Further In some embodiments, the thickness of the second radiation layer is one-fifth of the wavelength corresponding to the operating frequency. The optimization of different wavelengths can be achieved by the above optimization of the thickness of the radiation layer, and the performance of the radiation assembly can be further optimized.

In one embodiment according to the present disclosure, the first radiation window, the second radiation window, and the two radiation holes are constructed by way of etching or laser engraving. Compared with the traditional manufacturing process using a mold, manufacturing by way of etching or laser engraving can further improve the manufacturing accuracy, thereby improving the performance of the radiation assembly.

In addition, the second aspect of the present disclosure also proposes a waveguide antenna sub-array including at least one of the radiation assembly for the waveguide array antenna mentioned according to the first aspect of the present disclosure.

In one embodiment according to the present disclosure, the waveguide antenna sub-array further comprises:

a first coupling layer, a plurality of first coupling slots in the first coupling layer has a one-to-one correspondence with a plurality of second radiation windows in the second radiation layer, and the first coupling slot is staggered from the corresponding second radiation window by a first angle. In some embodiments, the first angle is 45 degrees. With the optimization of the interlayer feed network technology, the first-order polarization rotation from 0-degree to 45-degree is achieved.

In one embodiment according to the present disclosure, the waveguide antenna sub-array further comprises:

a power distribution layer having a plurality of H-shaped power distribution cavities, and the end of each power distribution cavity is corresponding to one of the first coupling slots in the first coupling layer.

In one embodiment according to the present disclosure, the waveguide antenna sub-array further comprises:

a second coupling layer having a plurality of second coupling slots and each of the plurality of second coupling slots is corresponding to one of the H-shaped power distribution cavities.

In one embodiment according to the present disclosure, the waveguide antenna sub-array further comprises:

a feed network layer, a plurality of feed network layer ends in the feed network layer are corresponding to the plurality of the second coupling slots and are configured to provide input signals for the assembly for the waveguide array antenna via the feed network layer.

In one embodiment according to the present disclosure, the waveguide antenna sub-array further comprises:

a substrate having a signal input terminal via which an input signal is input into the waveguide antenna sub-array.

Finally, the third aspect of the present disclosure proposes a waveguide array antenna comprising at least the radiation assembly for the waveguide array antenna mentioned according to the first aspect of the present disclosure or the waveguide antenna sub-array mentioned according to the second aspect of the present disclosure.

In summary, the radiation assembly according to the present disclosure is assembled by a vacuum diffusion welding process, and the radiation layer is independently manufactured by way of etching or laser engraving, thereby making the process accuracy higher and saving the corresponding mold-opening costs and reducing costs. Moreover, with the help of adding a metal grid between the first edges of the radiation window of the radiation assembly, the radiation assembly improves the purity of the aperture radiation polarization without reducing the gain to achieve a higher antenna cross polarization (XPD) index. In addition, with the distribution scheme of the rotating array element (diamond distribution), the tapered forming of the polarization component of the aperture field is realized, and the forming optimization of the pattern is realized under certain radiation efficiency attenuation conditions. The side lobe level is reduced to meet the ETSI level 3 requirements.

BRIEF DESCRIPTION OF THE DRAWINGS

The embodiments are shown and clarified with reference to the drawings. These drawings are used to clarify the basic principle, so that only the aspects necessary for understanding the basic principle are shown. The drawings are not to scale. In the drawings, the same reference numerals indicate similar features.

Other features, characteristics, advantages and benefits of the present disclosure will become more apparent through the following detailed description in conjunction with the accompanying drawings.

DETAILED DESCRIPTION

In the following detailed description of the preferred embodiments, reference will be made to the appended drawings constituting a part of the present disclosure. The appended drawings illustrate specific embodiments capable of implementing the present disclosure by way of example. The exemplary embodiments are not intended to be exhaustive of all embodiments according to the present disclosure. It can be understood that other embodiments can be used, and structural or logical modifications can also be made without departing from the scope of the present disclosure. Therefore, the following detailed description is not restrictive, and the scope of the present disclosure is defined by the appended claims.

Figure 1A:
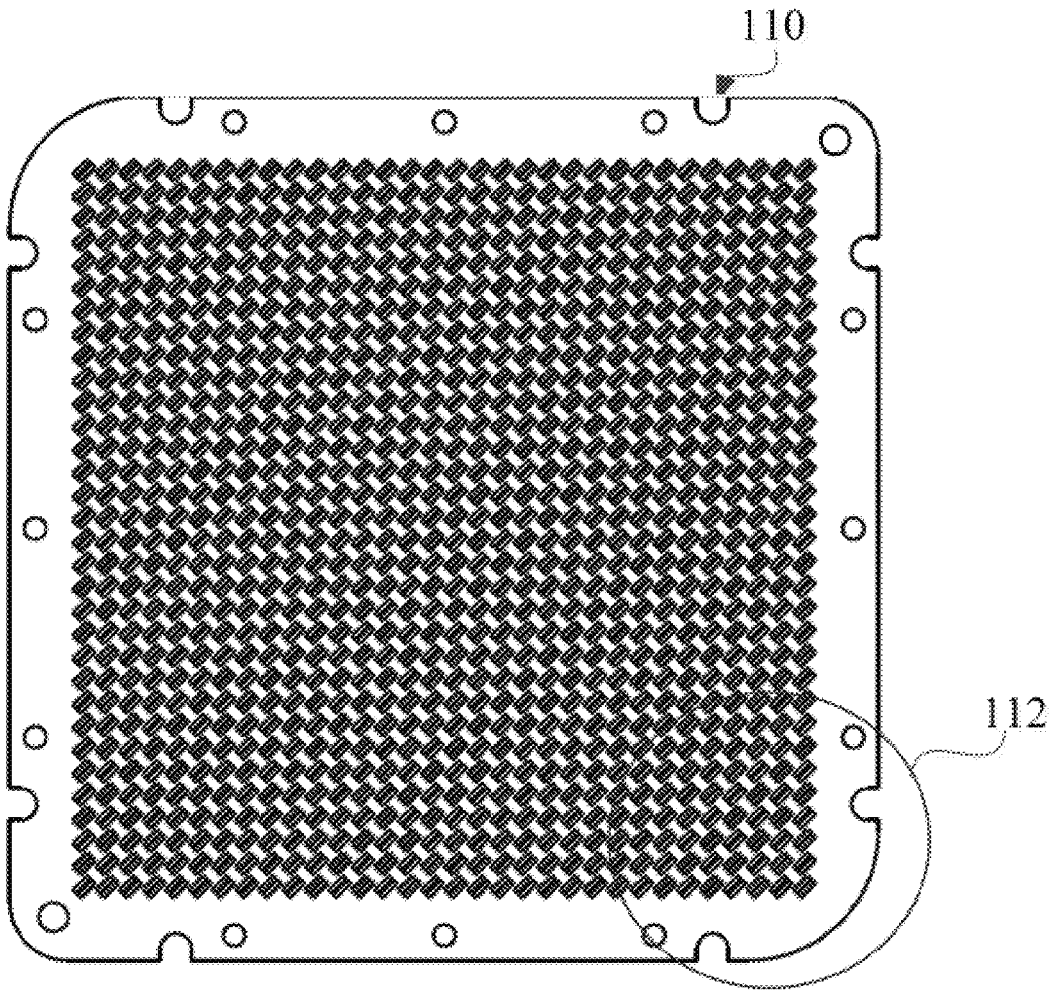
FIG. 1A shows an overall view of the first radiation layer 110 mentioned according to the present disclosure.
Figure 1B:
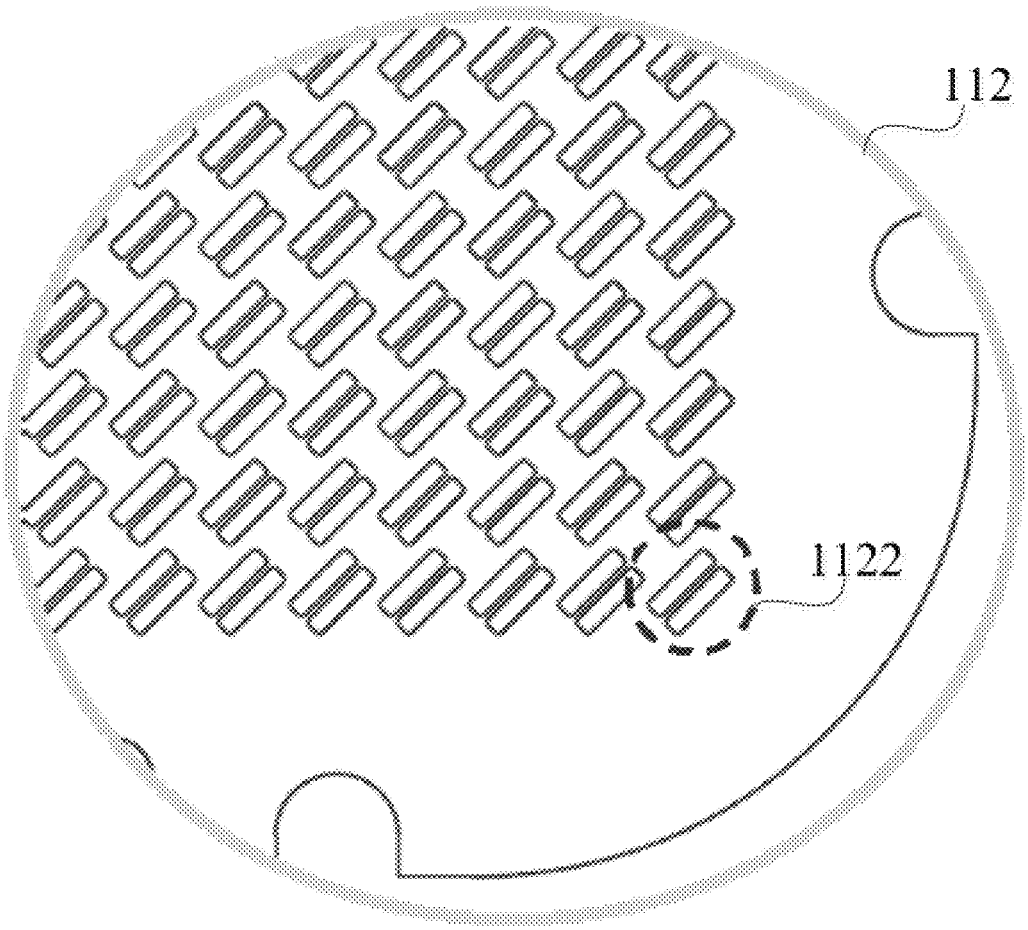
FIG. 1B shows a partial enlarged view of the part 112 of the first radiation layer 110 in FIG. 1A.

FIG. 1A shows an overall view of the first radiation layer 110 mentioned according to the present disclosure, and FIG. 1B shows a partial enlarged view of a part 112 of the first radiation layer 110 in FIG. 1A. As can be seen from FIGS.

1A and 1B, the radiation window 1122 of the first radiation layer 110 has a metal grid, so that each radiation window is divided into two radiation holes, so that the final signal radiates off through the surface of the radiation layer to optimize the XPD performance of the radiation assembly. In a preferred implementation according to the present disclosure, the metal grid is between first edges (e.g., relatively shorter/narrower edges) of the first radiation window and divides the first radiation window into the two radiation holes. In some embodiments, the metal grid is disposed in parallel with a second edge (e.g., relatively wider/longer edge) of the radiation window. The first radiation window comprises two oppositely disposed first edges and two second edges connecting the two first edges, and the metal grid is disposed between the two first edges, the metal grid is disposed in parallel with the second edge. The second edge is relatively longer than the first edges. This can further optimize the XPD performance of the radiation assembly.

Figure 2A:
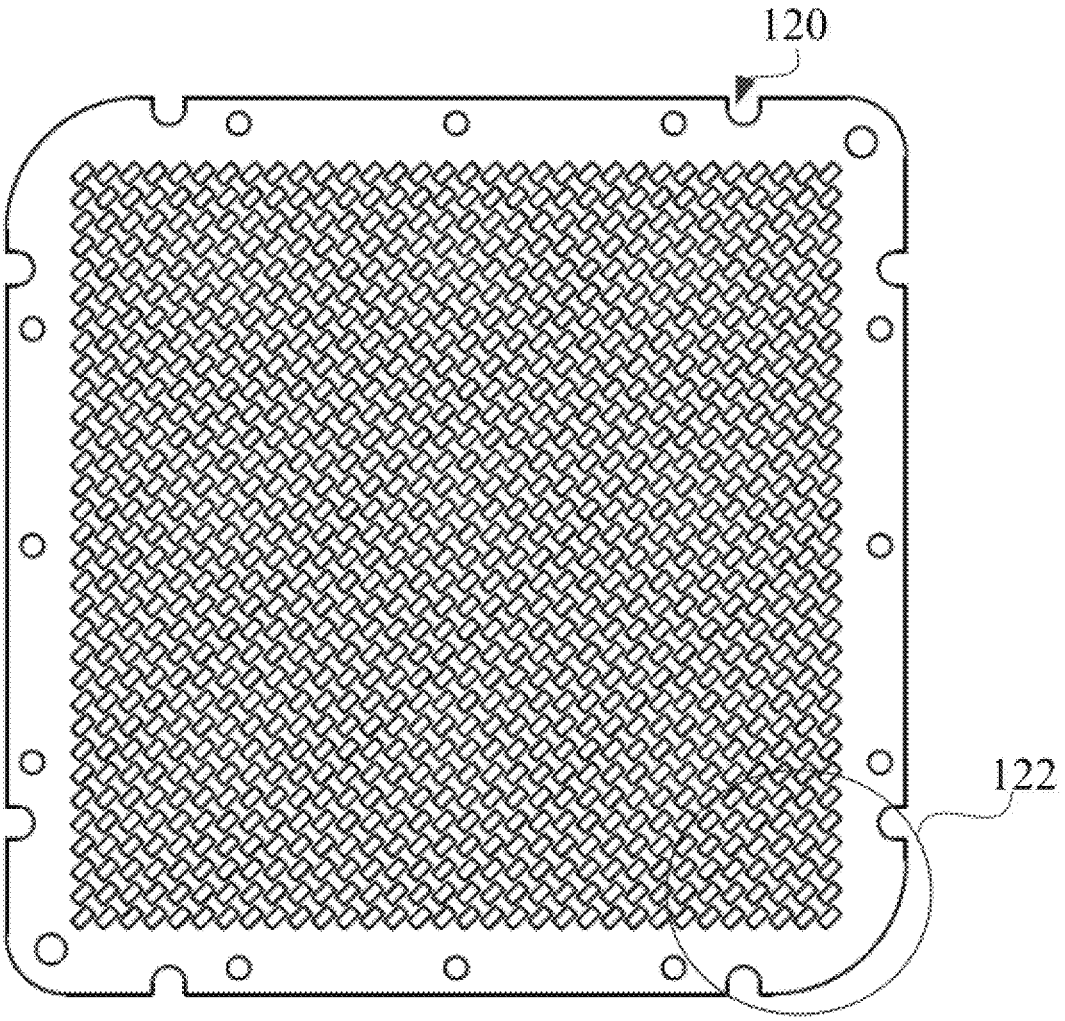
FIG. 2A shows an overall view of the second radiation layer 120 mentioned according to the present disclosure.
Figure 2B:
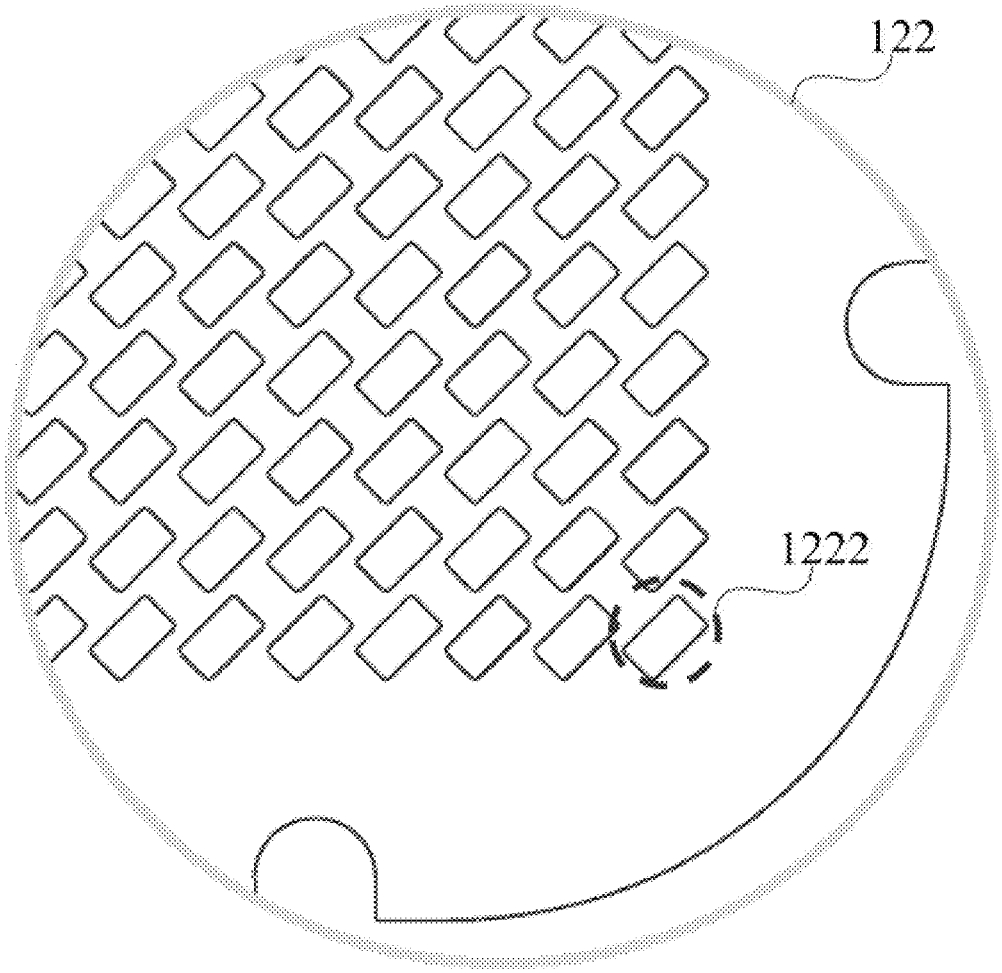
FIG. 2B shows a partial enlarged view of the part 122 of the second radiation layer 120 in FIG. 2A.

FIG. 2A shows an overall view of the second radiation layer 120 mentioned according to the present disclosure, and FIG. 2B shows a partial enlarged view of a part 122 of the second radiation layer 120 in FIG. 2A. It can be seen from FIGS. 2A and 2B that the second radiation layer 120 has a structure which is substantially same as the first radiation layer, whose difference being that there is no metal grid in the second radiation window on the second radiation layer 120, so that the cooperation between the first radiation layer 110 and the second radiation layer 120 can achieve a better XPD performance. In addition, the thickness of the second radiation layer 120 can be the same as the thickness of the first radiation layer 110, thereby facilitating to process; or the thickness of the second radiation layer 120 can further be arranged to be different from the thickness of the first radiation layer 110, moreover the thickness of the second radiation layer 120 is greater than the thickness of the first radiation layer 110, so as to further simplify the structure of the radiation assembly composed of the first radiation layer 110 and the second radiation layer 120. In some embodiments, in the case that the thickness of the second radiation layer 120 can be the same as the thickness of the first radiation layer 110, the second radiation layer 120 has at least two radiation sub-layers (not shown in the figures), and the at least two radiation sub-layers have the same structure. In one embodiment according to the present disclosure, the thickness of the first radiation layer 110 and the thickness of the second radiation layer 120 are associated with the operating frequency of the signal sent by the radiation assembly. In some embodiments, the thickness of the first radiation layer 110 is one twentieth of the wavelength corresponding to the operating frequency. Further In some embodiments, the thickness of the second radiation layer 120 is one-fifth of the wavelength corresponding to the operating frequency. The optimization of different wavelengths can be achieved by the above optimization of the thickness of the radiation layer, and the performance of the radiation assembly can be further optimized.

The first radiation layer 110 in FIGS. 1A and 1B and the second radiation layer 120 in FIGS. 2A and 2B can form a radiation assembly for a waveguide array antenna, and the radiation assembly comprises: a first radiation layer 110 having a plurality of first radiation windows 1122, and each of the plurality of first radiation windows 1122 has a metal grid that divides the corresponding first radiation window 1122 into two radiation holes; and the radiation assembly further comprises a second radiation layer 120 having a plurality of second radiation windows 1222, and the plurality of second radiation windows 1222 are corresponding to the plurality of first radiation windows 1122 one to one, and the plurality of second radiation windows 1222 of the second radiation layer 120 do not have a metal grid, wherein the thickness of the second radiation layer 120 is greater than that of the first radiation layer 110, and wherein the first radiation layer 110 and the second radiation layer 120 are manufactured independently of each other. In some embodiments, the first radiation layer 110 and the second radiation layer 120 are connected by way of vacuum diffusion welding. The radiation assembly according to the present disclosure is assembled by a vacuum diffusion welding process, and the radiation layer is independently manufactured by way of etching or laser engraving, thereby making the process accuracy higher and saving the corresponding mold-opening costs and reducing costs. Moreover, with the help of adding a metal grid between the first edges of the radiation window of the radiation assembly, the radiation assembly improves the purity of the aperture radiation polarization without reducing the gain to achieve a higher antenna cross polarization (XPD) index. Moreover, the radiation assembly according to the present disclosure reduces the side lobe level, thereby meeting the ETSI level 3 requirements.

In the implementations shown in FIGS. 1A, 1B, 2A, and 2B, the first radiation window 112, the second radiation window 122, and the two radiation holes are constructed by way of etching or laser engraving. Compared with the traditional manufacturing process using a mold, manufacturing by way of etching or laser engraving can further improve the manufacturing accuracy, thereby improving the performance of the radiation assembly.

Figure 3A:
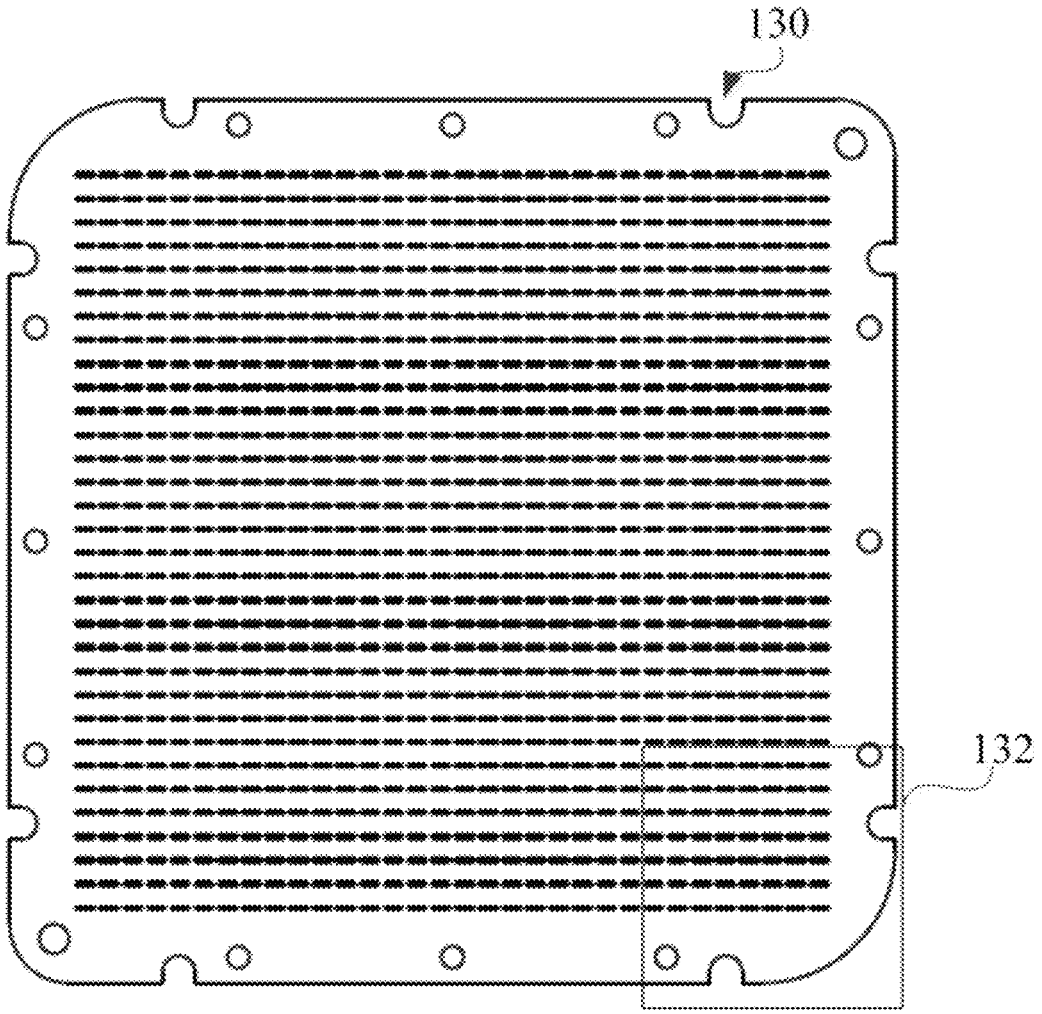
FIG. 3A shows an overall view of the first coupling layer 130 mentioned according to the present disclosure.
Figure 3B:
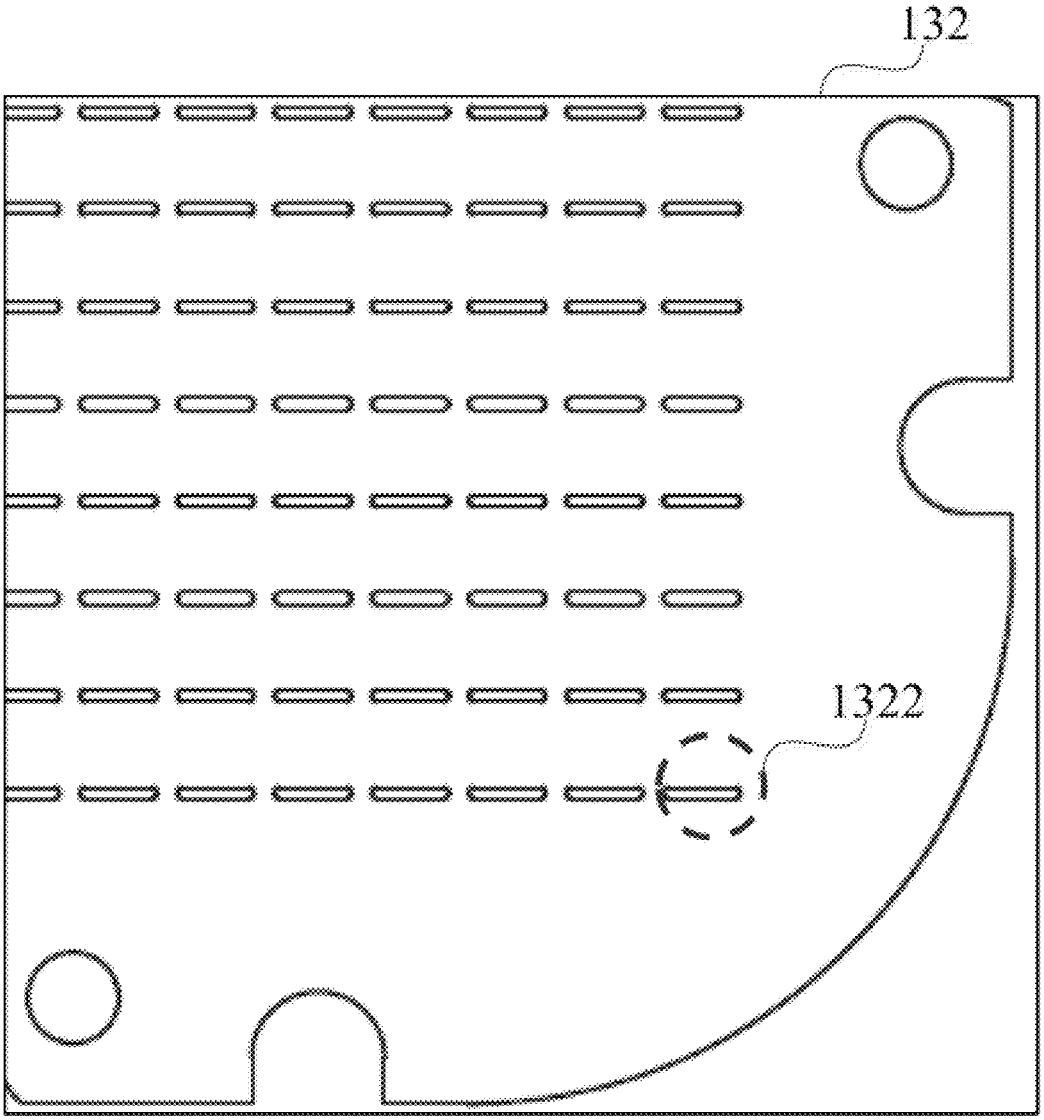
FIG. 3B shows a partial enlarged view of the part 132 of the first coupling layer 130 in FIG. 3A.

FIG. 3A shows an overall view of the first coupling layer 130 mentioned according to the present disclosure, and FIG. 3B shows a partial enlarged view of a part 132 of the first coupling layer 130 in FIG. 3A. It can be seen from the figures that the multiple first coupling slots 1322 in the first coupling layer 130 correspond to the multiple second radiation windows 1222 in the second radiation layer 120 one to one, and the first coupling slot 1322 and the corresponding second radiation window 1222 are staggered by a first angle. In some embodiments, the first angle is 45 degrees. With the optimization of the interlayer feed network technology, the first-order polarization rotation from 0-degree to 45-degree is achieved.

Figure 4A:
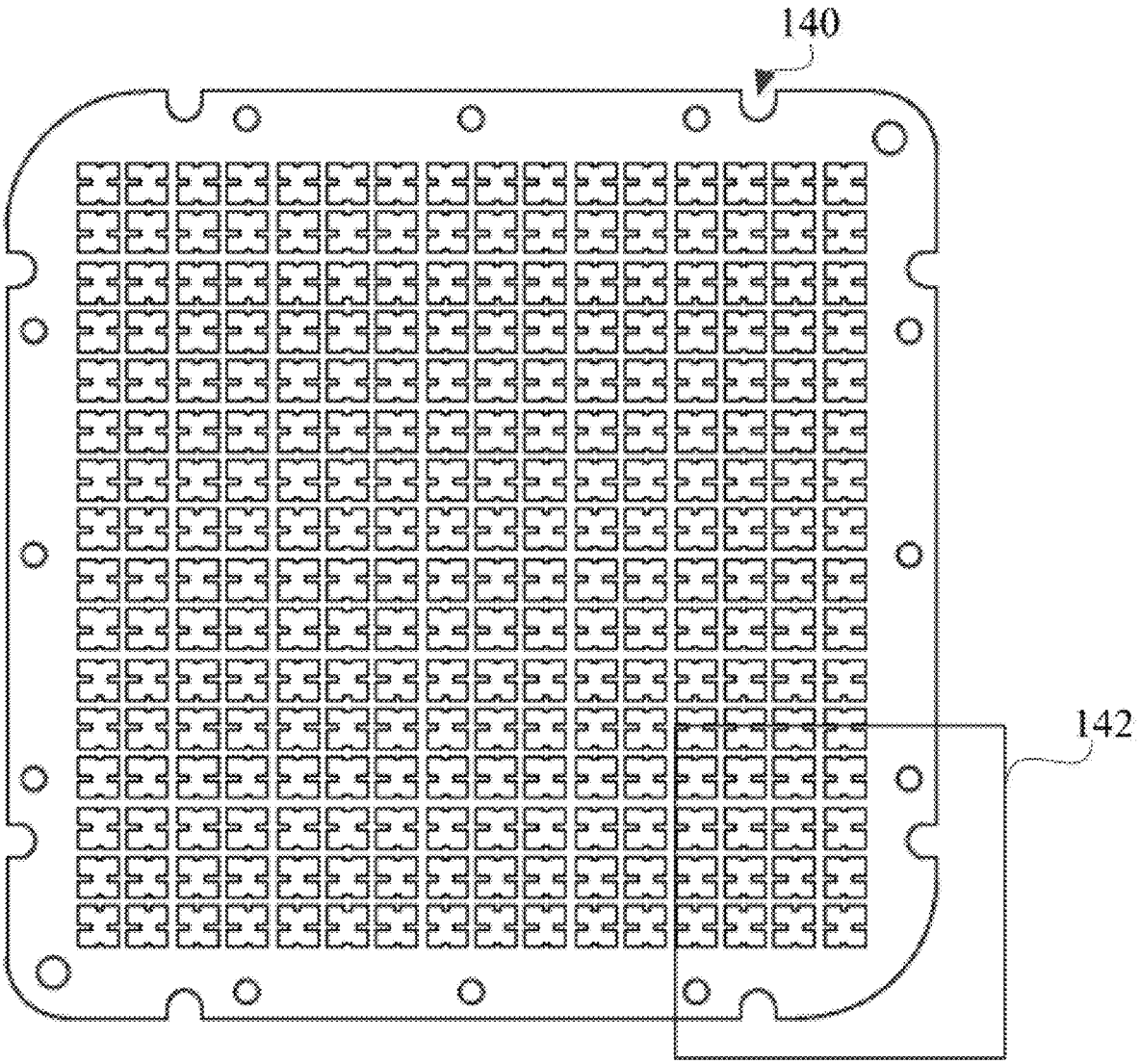
FIG. 4A shows an overall view of the power distribution layer 140 mentioned according to the present disclosure.
Figure 4B:
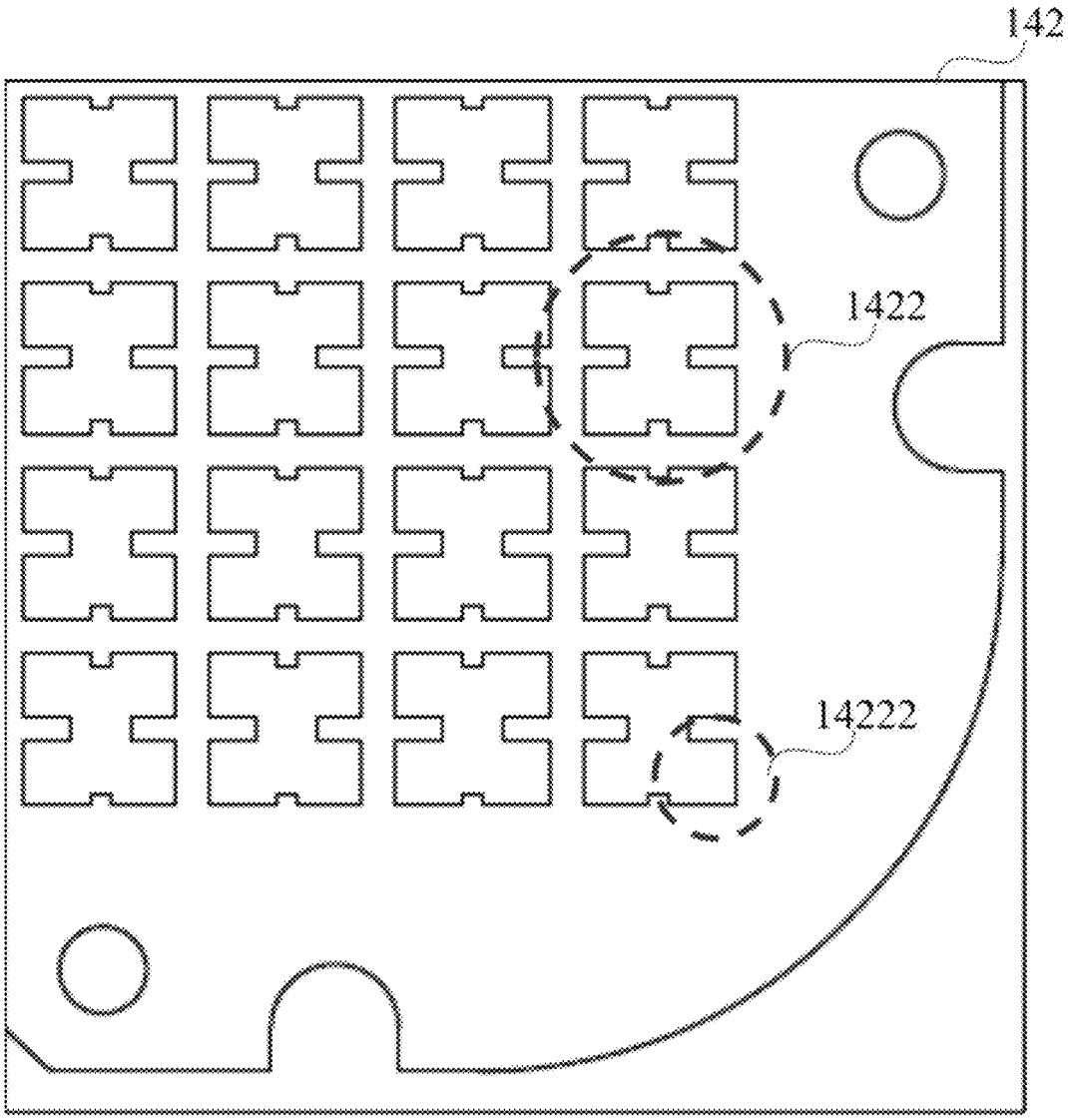
FIG. 4B shows a partial enlarged view of the part 142 of the power distribution layer 140 in FIG. 4A.

FIG. 4A shows an overall view of the power distribution layer 140 mentioned according to the present disclosure, and FIG. 4B shows a partial enlarged view of a part 142 of the power distribution layer 140 in FIG. 4A. As can be seen from the figures, the power distribution layer 140 has a plurality of H-shaped power distribution cavities 1422, and the end 14222 of each power distribution cavity 1422 is corresponding to a first coupling slot 1322 in the first coupling layer 130.

Figure 5A:
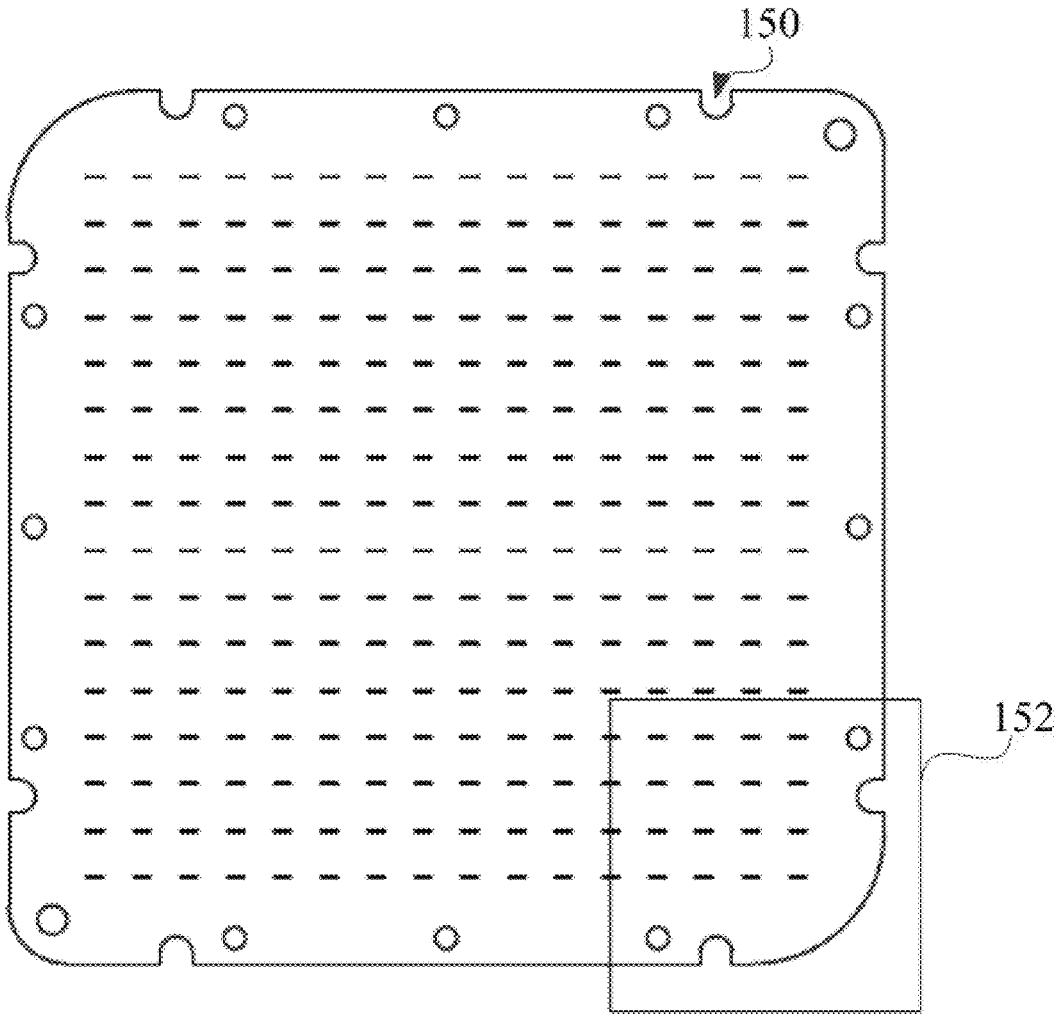
FIG. 5A shows an overall view of the second coupling layer 150 mentioned according to the present disclosure.
Figure 5B:
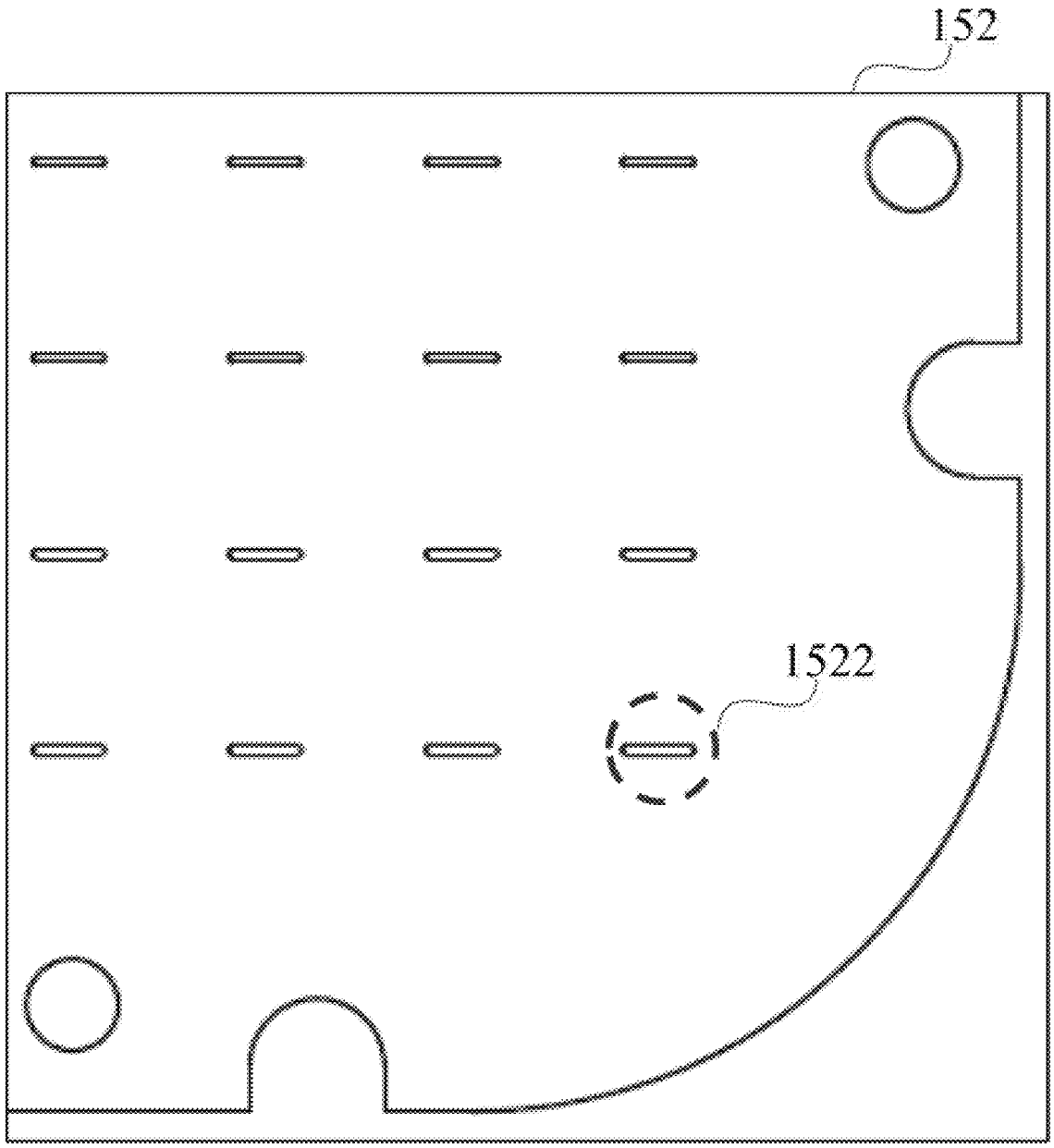
FIG. 5B shows a partial enlarged view of the part 152 of the second coupling layer 150 in FIG. 5A.

FIG. 5A shows an overall view of the second coupling layer 150 mentioned according to the present disclosure, and FIG. 5B shows a partial enlarged view of a part 152 of the second coupling layer 150 in FIG. 5A. It can be seen from the figures that the second coupling layer 150 has a plurality of second coupling slots 1522, and each of the plurality of second coupling slots 1522 corresponds to one power distribution cavity 1422.

Figure 6A:
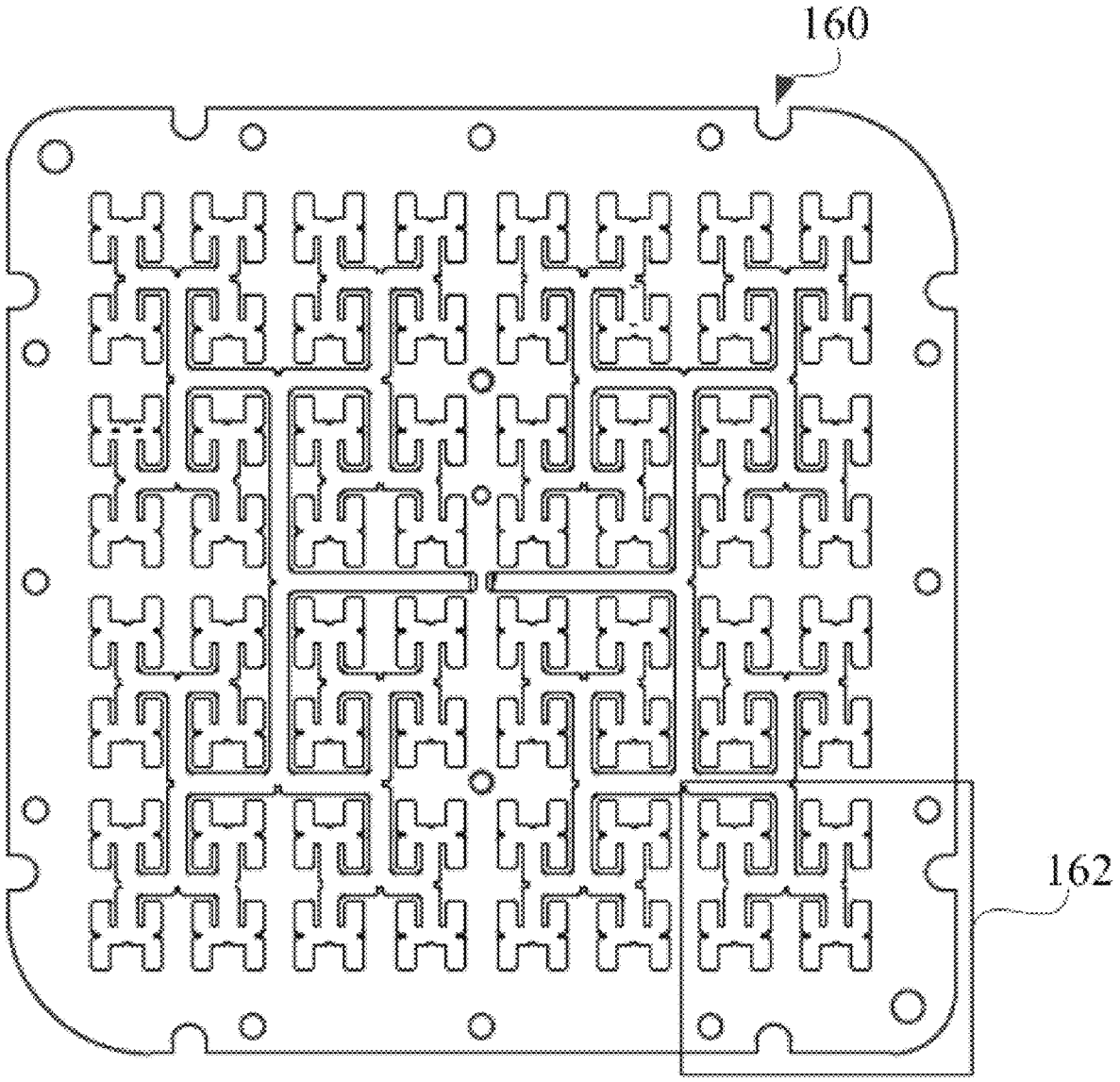
FIG. 6A shows an overall view of the feed network layer 160 mentioned according to the present disclosure.
Figure 6B:
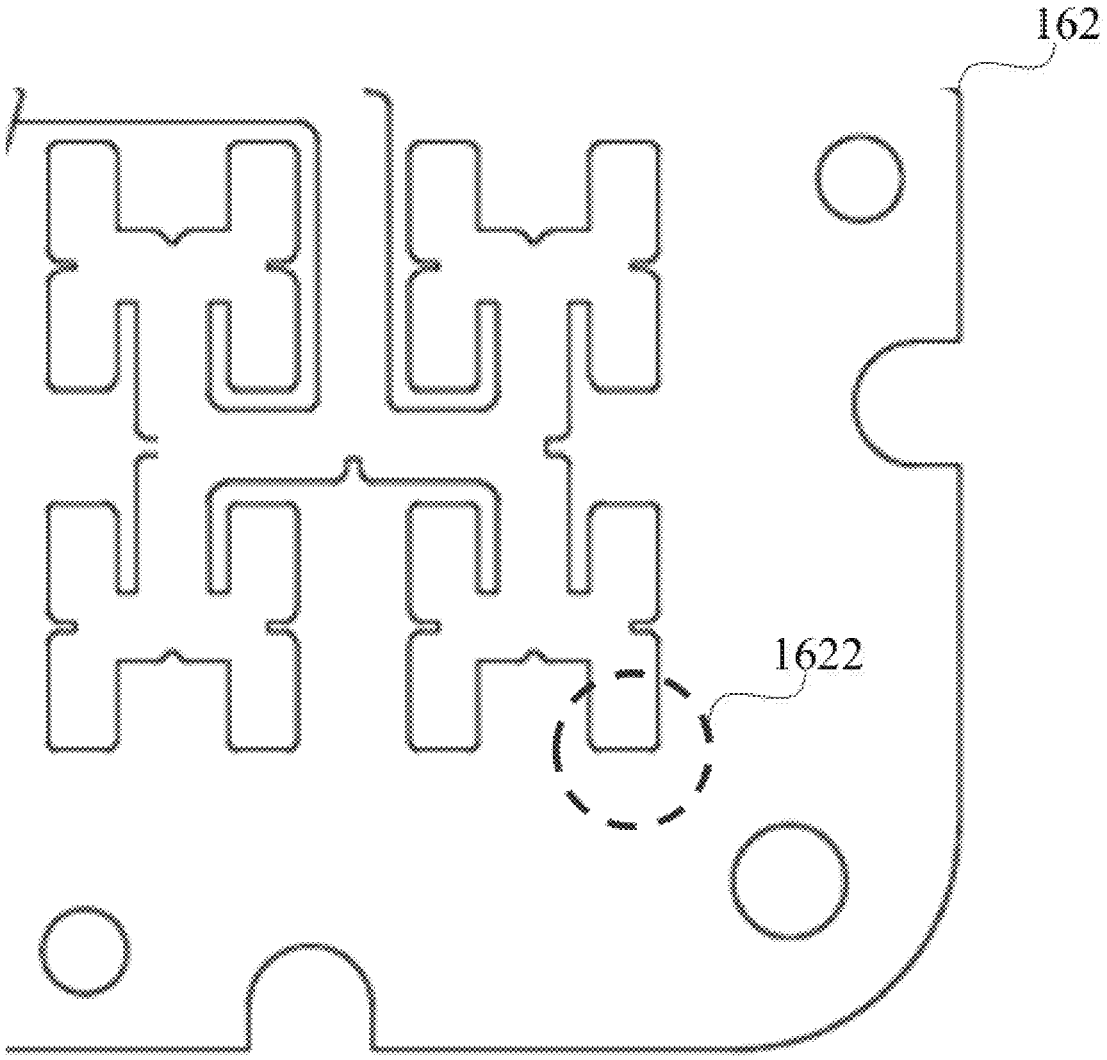
FIG. 6B shows a partial enlarged view of the part 162 of the feed network layer 160 in FIG. 6A.

FIG. 6A shows an overall view of the feed network layer 160 mentioned according to the present disclosure, and FIG. 6B shows a partial enlarged view of a part 162 of the feed network layer 160 in FIG. 6A. It can be seen from the figures that the plurality of feed network layer ends 1622 in the feed network layer 160 correspond to the plurality of second coupling slots 1522 and are configured to provide input signals for the assembly for the waveguide array antenna via the feeder network layer 160.

Figure 7:
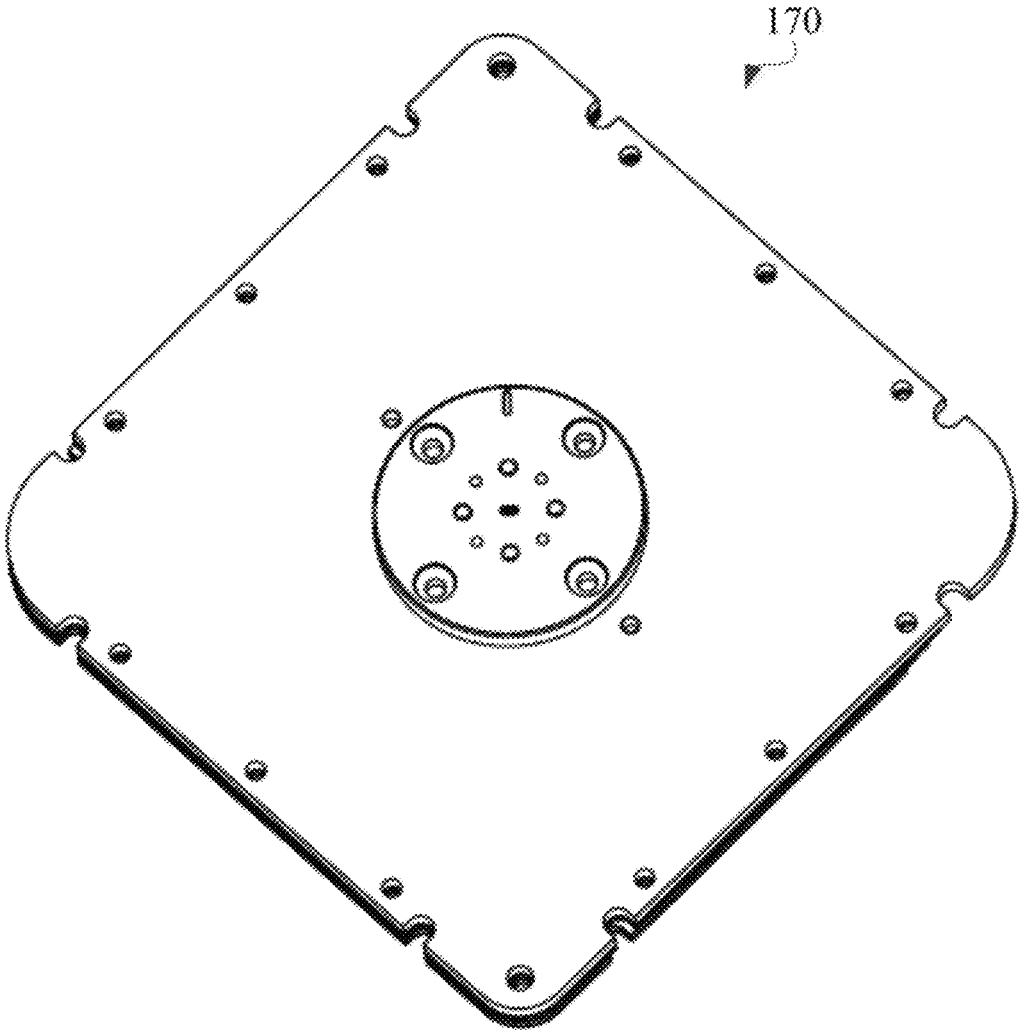
FIG. 7 shows an overall view of the substrate mentioned according to the present disclosure.

FIG. 7 shows an overall view of the substrate mentioned according to the present disclosure. It can be seen from FIG. 7 that there is a signal input terminal for inputting signals in the middle of the substrate.

The respective plates in FIGS. 1 to 6 can form the waveguide antenna sub-array proposed according to the second aspect of the present disclosure, the waveguide antenna sub-array comprises at least one radiation assembly for waveguide array antennas mentioned according to the first aspect of the present disclosure possible. In some embodiments, the waveguide antenna sub-array can also comprise the substrate shown in FIG. 7 to increase structural stability. That is, the waveguide antenna sub-array can further comprise a substrate 170 having a signal input terminal to input an input signal into the waveguide antenna sub-array via the signal input terminal.

Figure 8:
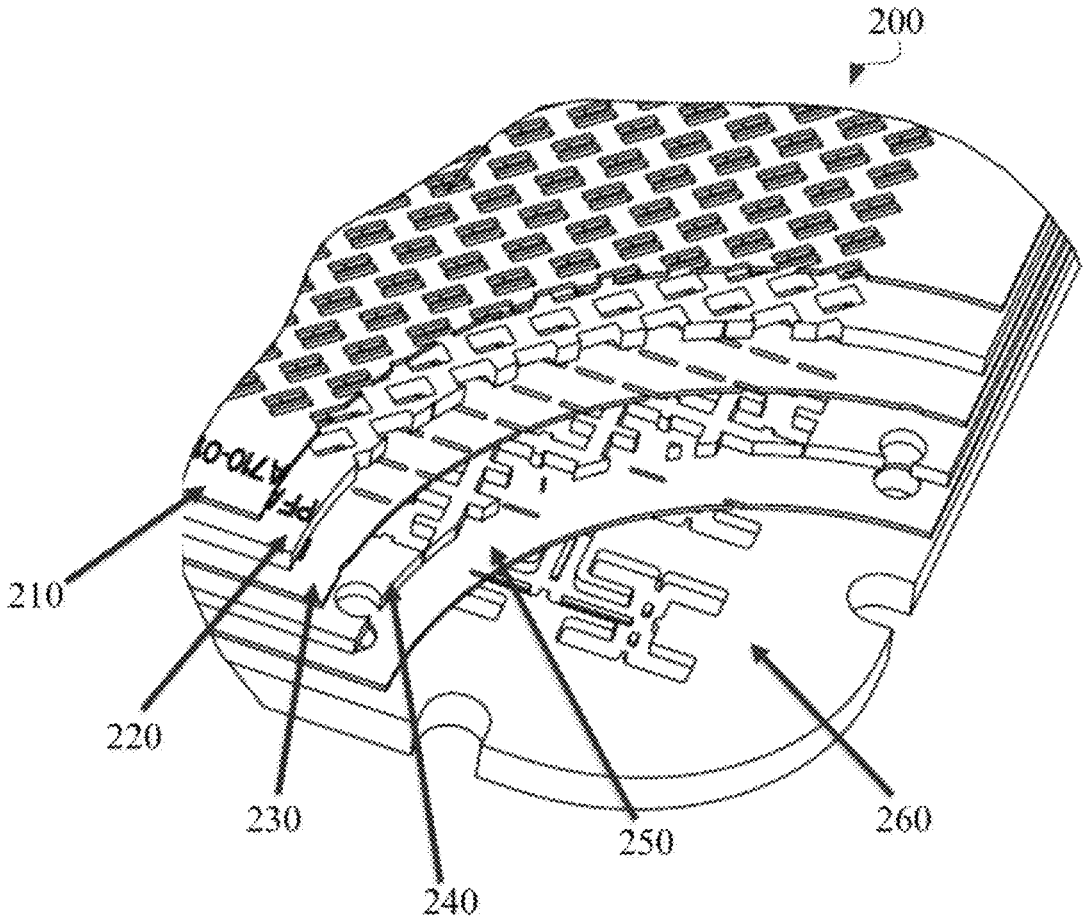
FIG. 8 shows a view of the waveguide antenna sub-array 200 mentioned according to the first embodiment of the present disclosure.

FIG. 8 shows a view of the waveguide antenna sub-array 200 mentioned according to the first embodiment of the present disclosure. It can be seen from the figure that the waveguide antenna sub-array 200, from top to bottom, comprises a first radiation layer 210, a second radiation layer 220, a first coupling layer 230, a power distribution layer 240, a second coupling layer 250, and a feed network layer 260. In this embodiment, both the first radiation layer 210 and the second radiation layer 220 are composed of only one layer of metal sheet, and the thickness of the metal sheet of the second radiation layer 220 is significantly greater than the thickness of the metal sheet of the first radiation layer 210. The product can be welded by thin slices with different thicknesses, each layer has different thickness, and the thickness range is 0.1~1 mm. Due to the different performance requirements, the cavity of each layer is designed with different shapes and sizes. Small and large cavities are disposed in the middle interlayer, the smallest layer is only 0.1 mm thick, which cannot be completed by machining or injection molding, and if the inner cavity is processed by 3D printing technology, the accuracy is far below the design requirements, in the present disclosure, these cavities are processed by etching or laser engraving, that is, the laser engraving process is selected to complete the process of different thicknesses of thin slices. At the same time, the bottom plate is completed by the CNC (Computer numerical control) process, and finally, the finished product is formed by vacuum diffusion welding after precise positioning of each layer.

Figure 9:
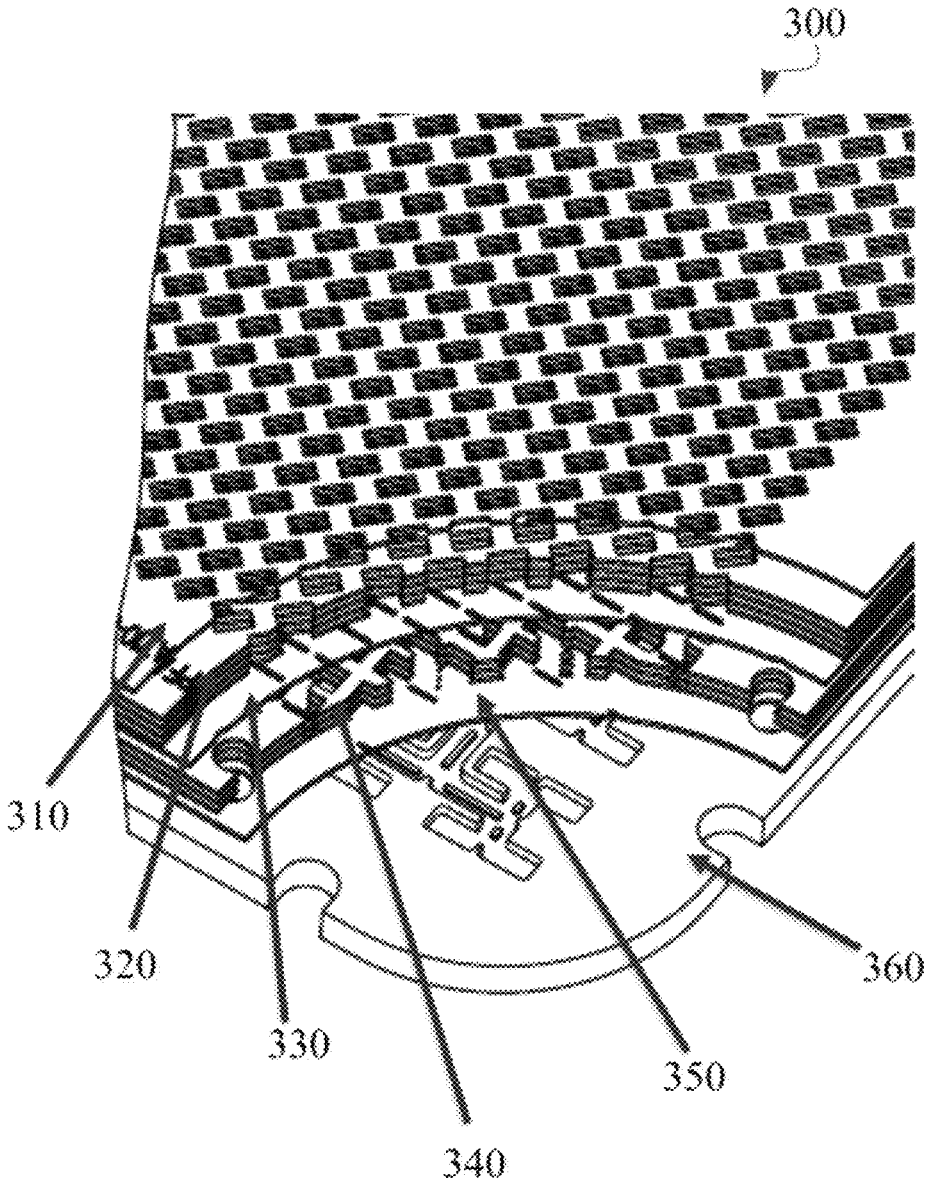
FIG. 9 shows a view of the waveguide antenna sub-array 300 mentioned according to the second embodiment of the present disclosure.

FIG. 9 shows a view of the waveguide antenna sub-array 300 mentioned according to the second embodiment of the present disclosure. It can be seen from the figure that the waveguide antenna sub-array 300, from top to bottom, comprises a first radiation layer 310, a second radiation layer 320, a first coupling layer 330, a power distribution layer 340, a second coupling layer 350, and a feed network layer 360. In this embodiment, the first radiation layer 310 is composed of only one metal sheet, and the second radiation layer 320 is composed of multiple metal sheets, and the thickness of the metal sheet of the second radiation layer 220 is significantly larger than that of the metal sheet of the first radiation layer 210. The product can be welded by thin slices of the same thickness, and the thickness range is 0.1~0.3 mm. Due to the different performance requirements, the cavity of each layer is designed with different shapes and sizes. Small cavities and large cavities are disposed in the middle interlayer, the thickness of the smallest layer is only 0.1 mm, which cannot be completed by machining or injection molding, and if the inner cavity is processed by 3D printing technology, the accuracy is far below the design requirements, in the present disclosure, these cavities processed by etching or laser engraving process, that is, the laser engraving process is selected to complete the process of different thicknesses of thin slices. At the same time, the bottom plate is completed by the CNC process. Finally, the finished product is formed by vacuum diffusion welding after precise positioning of each layer.

Finally, the third aspect of the present disclosure proposes a waveguide array antenna comprising at least the radiation assembly for the waveguide array antenna mentioned according to the first aspect of the present disclosure or comprising the waveguide antenna sub-array mentioned according to the second aspect of the disclosure.

In summary, the radiation assembly according to the present disclosure is assembled by a vacuum diffusion welding process, and the radiation layer is independently manufactured by way of etching or laser engraving, thereby making the process accuracy higher and saving the corresponding mold-opening costs and reducing costs. Moreover, with the help of adding a metal grid between the first edges of the radiation window of the radiation assembly, the radiation assembly improves the purity of the aperture radiation polarization without reducing the gain to achieve a higher antenna cross polarization (XPD) index. In addition, with the distribution scheme of the rotating array element (diamond distribution), the tapered forming of the polarization component of the aperture field is realized, and the forming optimization of the pattern is optimized under certain radiation efficiency attenuation conditions. The side lobe level is reduced to meet the ETSI level 3 requirements.

Figure 10:
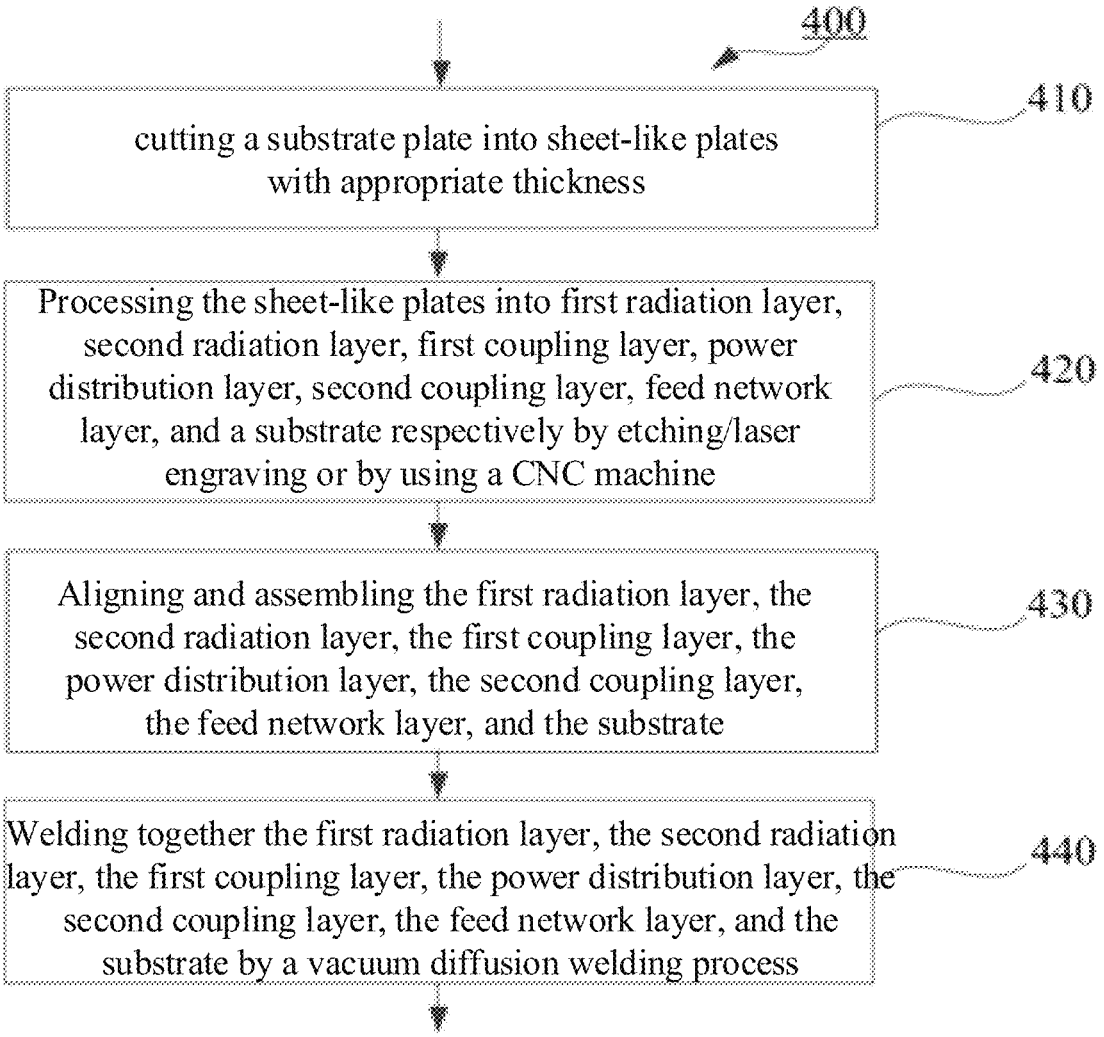
FIG. 10 shows a flowchart of a method 400 used in the vacuum diffusion welding process according to the present disclosure.

FIG. 10 shows a flowchart of a method 400 used in the vacuum diffusion welding process according to the present disclosure. Diffusion welding is a pressure welding method in which two closely-fitting weldments are maintained in a vacuum or protective atmosphere via a certain temperature and pressure, so that the atoms on the contact surface are mutually diffused to complete the welding.

The vacuum diffusion welding process has the following four characteristics, namely:

- First, because there is no flux, the internal cavity will not retain flux;
- Secondly, the heating temperature does not reach the melting point, and the cavity will not deform to affect the dimensional accuracy;
- Thirdly, the fusion of the same substances will not cause reliability problems such as electro-erosion, and corrosion;
- Finally, the physical, chemical, mechanical and electrical properties of the original base metal are maintained after welding.

The conventional diffusion welding process flow is followed, namely:

- Object Assembly→cleaning→placing in the welding furnace→heating to the specified temperature within the specified time→pressurizing and heat preserving for a certain time→depressurization cooling→taking out the object.

Depending on the material, the thickness of the material, the pressure, temperature and holding time will be different. For example: the welding temperature of copper material is about 1140° C., the pressurization is about 6 MPa, and the welding time is about 10 hours.

It can be seen from FIG. 10 that the method 400 generally comprises the following four steps, firstly, in the method step 410, the substrate plate is cut into sheet-like plates with appropriate thickness; then, in the method step 420, the sheet-like plate is processed into a first radiation layer (for example, first radiation layer 110, 210, or 310), a second radiation layer 120, 220, or 320, a first coupling layer 130, 230, or 330, a power distribution layer 140, 240, or 340, a second coupling layer 150, 250, or 350, a feed network layer 160, 260, or 360, and a substrate 170 respectively by etching/laser engraving or by using a computer numerical control (CNC) machine. Next, in the method step 430, the first radiation layer 110, 210, or 310, the second radiation layer 120, 220, or 320, the first coupling layer 130, 230, or 330, the power distribution layer 140, 240, or 340, the second coupling layer 150, 250, or 350, the feed network layer 160, 260, or 360, and the substrate 170 are aligned and assembled; finally, in the method step 440, the first radiation layer 110, 210, or 310, the second radiation layer 120, 220, or 320, the first coupling layer 130, 230, or 330, the power distribution layer 140, 240, or 340, the second coupling layer 150, 250, or 350, the feed network layer 160, 260, or 360, and the substrate 170 are welded together by performing a vacuum diffusion welding process.

More specifically, the present disclosure provides a broadband high-gain, low-side lobe, low-profile waveguide array antenna, which comprises several broadband antenna sub-arrays and a waveguide broadband power distribution feed network, the broadband antenna sub-array comprises a radiation unit, a radiation unit coupling slot, a sub-array power distribution layer, a power distribution layer coupling slot, and a feed waveguide, wherein the radiation unit is located in the first layer (the uppermost layer), and the radiation unit coupling slot is located between the radiation unit and the sub-array power distribution layer, which is on the second layer; the sub-array power distribution layer is in the third layer, the power distribution layer coupling slot is in the fourth layer, and the feed waveguide is in the fifth layer. Among others, the input terminal of the waveguide broadband power distribution feed network is an E-plane waveguide magic T, the input terminal of the E-plane waveguide is used as the antenna input terminal, and the two output terminals are respectively cascaded with several H-plane waveguide magic T. The waveguide broadband power distribution feed network end is connected to the broadband antenna sub-array input waveguide. Further, several broadband antenna sub-arrays are arranged in a diamond shape. Furthermore, each broadband sub-array comprises four radiation units, four radiation unit coupling slots, one sub-array power distribution layer, one power distribution layer coupling slot, and one feed waveguide. Further, there is a metal grid located on the center line of the first edge, on the upper surface of the radiation unit, which divides the radiation unit into two halves. Furthermore, the profile of the sub-arrays power distribution layer is similar to the lying letter "H". The radiation unit coupling slot is located at the four ends of "H". Further, the geometric center of the radiation unit coincides with the geometric center of the radiation unit coupling slot, and the radiation unit and the radiation unit coupling slot form an angle of 45 degrees. Further, the geometric center of the upper surface of the power distribution layer coupling slot coincides with the geometric center of the lower surface of the sub-array power distribution layer. Further, the power distribution layer coupling slot is located on the wide edge surface of the feeding waveguide, parallel to the waveguide, and deviated from the geometric centerline of the waveguide. Further, the input terminal of the E-plane magic T is a standard waveguide, and the two output terminal waveguides adopt a single-ridge waveguide structure. Further, the H-plane magic T has two forms: the H-plane magic T input terminal at the end is a single-ridge waveguide structure, and the two output terminals are standard waveguides. All three terminals of the middle cascaded H-plane magic T adopt a single-ridge waveguide structure. The radiation unit in the present invention adopts a diamond-shaped array layout to implement the tapered forming of the polarization component of the aperture field, and implement the forming optimization of the pattern under a certain radiation efficiency attenuation condition. The side lobe level is reduced to meet ETSI Class 3 requirements. By adding grid s in the center of the first edge of the radiation window of the radiation unit, parallel to the wide edge, the antenna cross polarization (XPD) of the antenna is effectively improved without reducing the gain. In the present invention, with the optimization of the interlayer feed network, the 0-degree to 45-degree polarization first-order rotation is achieved, so that the whole structure scheme is more compact and more process cost. The feed network in the present invention adopts the combined form of E-plane magic T and H-plane magic T, so that the antenna input terminal is located at the geometric center of the antenna, which is beneficial to integration and installation of the transmission outdoor unit. The waveguide broadband feed network in the present invention mainly adopts a single-ridge waveguide structure to effectively improve the working bandwidth and reduce the volume.

In summary, the radiation assembly according to the present disclosure is assembled by a vacuum diffusion welding process, and the radiation layer is independently manufactured by way of etching or laser engraving, thereby making the process accuracy higher and saving the corresponding mold-opening costs and reducing costs. Moreover, with the help of adding a metal grid between the first edges of the radiation window of the radiation assembly, the radiation assembly improves the purity of the aperture radiation polarization without reducing the gain to achieve a higher antenna cross polarization (XPD) index. In addition, with the distribution scheme of the rotating array element (diamond distribution), the tapered forming of the polarization component of the aperture field is realized, and the forming optimization of the pattern is realized under certain radiation efficiency attenuation conditions. The side lobe level is reduced to meet the ETSI level 3 requirements. Finally, the laser engraving of the substrate can meet the key small size accuracy requirements, and the multilayer substrates are laminated and combined by vacuum diffusion welding to finally achieve the overall electrical index.

Those skilled in the art should understand that the modifications and variations of the various embodiments disclosed above can be made without departing from the spirit or scope of the invention. Therefore, the protection scope of the present disclosure should be defined by the appended claims.

Although different exemplary embodiments of the present disclosure have been described, it is obvious to those skilled in the art that various changes and modifications can be made, which can achieve some of the advantages of the present disclosure without departing from the spirit or scope of this present disclosure. For those who are quite skilled in the art, other components performing the same function can be appropriately replaced. It should be mentioned that the features explained here with reference to a particular figure can be combined with features of other figures, even in those cases where this is not explicitly mentioned. In addition, the method of the present disclosure can be implemented either in all software implementations using appropriate processor instructions or in a hybrid implementation using a combination of hardware logic and software logic to achieve the same result. Such modifications to the solution according to the present disclosure are intended to be covered by the appended claims.

What is claimed is:

1. A radiation assembly for a waveguide array antenna, the radiation assembly comprising, in this order:

a first radiation layer including a first radiation window, the first radiation window including a metal grid that divides the first radiation window into two radiation holes;

a second radiation layer including a second radiation window in correspondence with the first radiation window, and the second radiation window excludes the metal grid;

a first coupling layer in correspondence with the second radiation layer;

a power distribution layer including an H-shaped power distribution cavity in correspondence with the first coupling layer; and a second coupling layer in correspondence with the H-shaped power distribution cavity, the second coupling layer being different than the power distribution layer, wherein the H-shaped power distribution cavity includes four corner ends and a center portion surrounded by the four corner ends, and all of the four corner ends and the center portion are part of the cavity, wherein a thickness of the second radiation layer is greater than a thickness of the first radiation layer, and wherein the first radiation layer and the second radiation layer are manufactured independently of each other.

2. The radiation assembly according to claim 1, wherein the first radiation window comprises two oppositely disposed first edges, and the metal grid is positioned between the two first edges of the first radiation window to equally divide the first radiation window into the two radiation holes.

3. The radiation assembly according to claim 2, wherein the first radiation window further comprises a second edge connecting the two first edges, and the metal grid and the second edge of the first radiation window are disposed in parallel, the second edge being longer than the first edges.

4. The radiation assembly according to claim 1, wherein the thickness of the first radiation layer and the thickness of the second radiation layer are associated with an operating frequency of a signal sent by the radiation assembly.

5. The radiation assembly of claim 4, wherein the thickness of the first radiation layer is one twentieth of a wavelength corresponding to the operating frequency.

6. The radiation assembly according to claim 4, wherein the thickness of the second radiation layer is one-fifth of a wavelength corresponding to the operating frequency.

7. The radiation assembly according to claim 1, wherein the first radiation layer is composed of only one metal sheet, and the second radiation layer is composed of multiple metal sheets.

8. The radiation assembly according to claim 1, wherein the first radiation layer includes a first metal sheet and contacts the second radiation layer with a first metal weld; or the second radiation layer includes a second metal sheet and contacts the first coupling layer a second metal weld.

9. A waveguide antenna, comprising a radiation assembly, the radiation assembly comprising, in this order:

a first radiation layer including a first radiation window, the first radiation window including a metal grid that divides the first radiation window into two radiation holes;

a second radiation layer including a second radiation window in correspondence with the first radiation window, and the second radiation window excludes the metal grid;

a first coupling layer in correspondence with the second radiation layer;

a power distribution layer including an H-shaped power distribution cavity in correspondence to the first coupling layer; and a second coupling layer in correspondence with the H-shaped power distribution cavity, the second coupling layer being different than the power distribution layer, wherein the H-shaped power distribution cavity includes four corner ends and a center portion surrounded by the four corner ends, and all of the four corner ends and the center portion are part of the cavity, wherein a thickness of the second radiation layer is greater than a thickness of the first radiation layer, and wherein the first radiation layer and the second radiation layer are manufactured independently of each other.

10. The waveguide antenna according to claim 9, wherein a first coupling slot of the first coupling layer is staggered from the second radiation window by a first angle.

11. The waveguide antenna according to claim 9, wherein the H-shaped power distribution cavity of the power distribution layer is in correspondence with the first coupling slot of the first coupling layer.

12. The waveguide antenna according to claim 9, wherein the waveguide antenna further comprises:

a feed network layer configured to provide input signals for the radiation assembly.

13. The waveguide antenna according to claim 12, wherein the waveguide antenna further comprises:

a substrate having a signal input terminal via which an input signal is input into the waveguide antenna.

14. The waveguide antenna according to claim 12, wherein the second coupling layer is positioned between the power distribution layer and the feed network layer.

15. The waveguide antenna according to claim 13, wherein the feed network layer is positioned between the second coupling layer and the substrate.

* * * * *